United States Patent [19]

Dettmann et al.

[11] 4,291,358

[45] Sep. 22, 1981

[54] MAGNETIC VALVE WITH ELECTRONIC CONTROL

[75] Inventors: Heinrich Dettmann, Niedernhall; Wolfgang Pfeiffer, Künzelsau-Garnberg, both of Fed. Rep. of Germany

[73] Assignee: Bürkert GmbH, Ingelfingen, Fed. Rep. of Germany

[21] Appl. No.: 55,930

[22] Filed: Jul. 6, 1979

[30] Foreign Application Priority Data

Jul. 6, 1978 [EP] European Pat. Off. ..... 781000313.2

[51] Int. Cl.[3] ..... H01H 47/10

[52] U.S. Cl. ..... 361/154; 251/129; 251/137; 361/196

[58] Field of Search ..... 231/129, 141, 137, 131; 331/256, 268; 301/152, 154, 159, 196, 197, 198; 123/32 EF; 335/256

[56] References Cited

U.S. PATENT DOCUMENTS 3,525,021 8/1970 Engman ..... 361/198

3,582,715 6/1971 Traina ..... 361/198

3,737,736 6/1973 Stampfli ..... 361/154

4,065,096 12/1977 Frantz et al. ..... 335/256 X 4,114,184 9/1978 Stampfli ..... 361/154

*Primary Examiner*—Harry E. Moose, Jr.

*Attorney, Agent, or Firm*—Edwin E. Greigg

[57] ABSTRACT

The magnetic valve with electronic control for increasing the attractive output has an energizing coil (AE), which is supplied in the attracting phase with an increased energizing current via a closed switch (T2). In the maintenance phase, the energizing coil (AE) is supplied with a maintenance current, via a compensating resistor (RV) and with the switch (T2) opened, which is lower than the energizing current. For the purpose of controlling the switch (T2), a timing circuit is provided which includes a resistor (R2) and a capacitor (C2). The magnetic valve is selectively drivable with alternating current or direct current. A portion of the energizing coil (AE) is made up of the compensating resistor (RV), which is embodied as a resistor wire and wound up on the energizing coil (AE).

5 Claims, 2 Drawing Figures

MAGNETIC VALVE WITH ELECTRONIC CONTROL

BACKGROUND OF THE INVENTION

The invention relates to a magnetic valve with electronic control.

The magnetic valve has an energizing coil through which an energizing current passes via a closed switch of the electronic control. The electronic control also includes a maintenance phase which supplies the energizing coil with a maintenance current. The maintenance current is reduced with respect to the energizing current, and this is accomplished via a compensating resistor arranged parallel to the switch, with the switch in this instance being open.

Magnetic valves with electronic control of this kind are known from German Offenlegunsschrift (laid open application) No. 24 02 083. In these magnetic valves, an increased current is briefly directed through the energizing coil of the valve in order to increase the attractive force applied to the valve armature. In order to overcome the mass inertia of the moving parts of the magnetic valve and the spring force of the restoring spring which is normally provided, a substantially higher level of energy is required than is needed to maintain the valve in its switched-on or open state.

Also, the electrical current requirement for rapid and sure attraction of the armature of the magnetic valve is still further increased by the fact that the inductance of the energizing coil is substantially smaller when the armature is at rest (valve closed) than when it is not (valve open). Thus, because of the brief increase in the electrical current directed through the energizing coil, the maintenance current may be selected to be substantially smaller. Consequently, heating of the magnetic valve may be kept below the permissible upper limit, even when the valve is switched on for long periods. This permissible upper limit is frequently approximately 80° C.

A further advantage of this feature is in that as a result of the increase in the force of attraction thus attained, the switching behavior of the magnetic valve is improved as well. In particular, shorter switching times can be attained.

In the magnetic valve of the German Offenlegungsschrift No. 24 02 083 already mentioned, the compensating resistor is bridged by a semiconductor switching triode or a cold conductor. The semiconductor switching triode is controlled in accordance with the induction of the energizing coil. In the attracting phase of the magnetic valve, the semiconductor switching triode is in a conductive state and therefore short-circuits the compensating resistor. If the magnetic valve has attained its working or open state, then, as a result of an increase in the induction of the energizing coil, the semiconductor switching triode is blocked. Thus, on account of the compensating resistor, a low-level current flows through the energizing coil, which is sufficient to hold the magnetic valve in its working position.

An alternating current is required as the operating current for actuating the magnetic valve. The use of the known magnetic valve is thus restricted, because of the mode of operation of the control electronics, to operation with alternating current.

Magnetic valves with electronic control for increasing the attractive output are also known in which a controllable rectifier is located in series with the energizing coil. The instant of ignition of the controllable rectifier is varied by a phase intersection control means in such a fashion that during the attracting phase, the ignition occurs sooner, and during the maintenance phase, the ignition occurs later. This known apparatus, disclosed in the German Offenlegungsschrift (laid open application) No. 25 11 564 or No. 20 23 108, for example, also has the disadvantage in that an alternating current or a pulsating direct current is required, or else a supplementary timing generator is required.

OBJECT, SUMMARY AND ADVANTAGES OF THE INVENTION

It is accordingly a principal object of the invention to provide a magnetic valve with electronic control for briefly increasing the attractive output of the valve, the valve being suitable for operation both with alternating current and with direct current, i.e., the same magnetic valve is intended to be drivable selectively with direct current or with alternating current.

The electronic control of the magnetic valve is intended to be small in volume, so that it can be installed within an available cavity in the magnetic valve. In addition, with a given volume of the energizing coil or the electromagnet, heat build-up during the maintenance phase of operation is intended to be reduced; i.e., the required maintenance current should be lowered.

This object is attained in a magnetic valve of the kind described above which is characterized in accordance with the invention by the provision of a timing circuit containing one resistor and one capacitor for the control of a switch. The use of the simply structured timing circuit enables the operation of the magnetic valve with alternating voltage or direct voltage selectively, because the control is determined by the time constant of the timing circuit and not by the frequency or phase relationship of an alternating voltage.

In accordance with one suitable embodiment of the invention, a full-wave rectifier is located in front of the electronic control for the operation of the magnetic valve with alternating voltage. As a result, the operation of the magnetic valve can be accomplished not only selectively with either alternating current or direct current, but with an arbitrary polarity of the direct voltage as well.

In accordance with a further advantageous embodiment of the invention, a current amplification element is interposed between the timing circuit and the switch. As a result, the timing circuit, with a given constant, can be embodied in a particularly space-saving manner.

Still another advantageous embodiment of the invention contains a voltage limiter circuit located in front of the timing circuit. As a result, the magnetic valve can be operated with variably high levels of voltage. The voltage limiter circuit can have an equalizing device in the form of an equalizing capacitor associated with it.

In accordance with a particularly advantageous embodiment of the invention, the compensating resistor is embodied as a resistance wire, which forms a portion of the energizing winding. The compensating resistor thus contributes to the number of ampere turns of the energizing coil. As a result, the size of the actual energizing coil can be reduced; or, if the size remains the same, then the maintenance current and the maintenance output can be reduced. Furthermore, this feature produces less heat build-up of the magnetic valve during the maintenance phase.

The invention will be better understood, and further object and advantages thereof will become more apparent from the ensuing detailed description of a preferred embodiment taken in conjuction with the drawings.

DESCRIPTION OF THE PREFERRED EMBODIMENT

Figure 1:
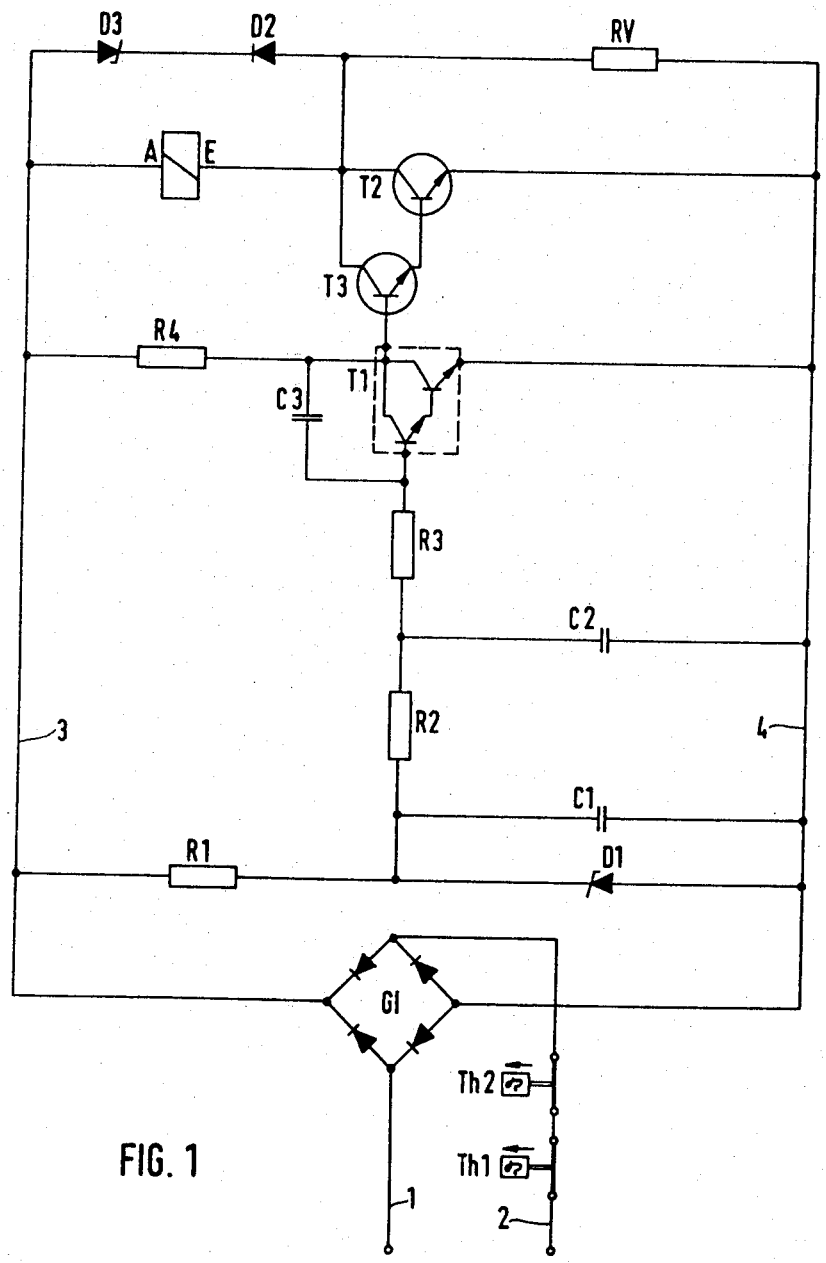
FIG. 1 is a circuit diagram of an electronic control for the magnetic valve according to the invention.

The electronic control of the magnetic valve which is shown in FIG. 1 substantially comprises a full-wave rectifier G1, a voltage limiting circuit including a resistor R1 and a Zener diode D1, a timing circuit including a resistor R2 and a capacitor C2, a current amplification element T1 embodied as a Darlington pair, an electronic switch made up of two transistors T2, T3 arranged in a Darlington pair, and a compensating resistor RV.

An operating voltage is supplied to the alternating-current terminals of the full-wave rectifier via leads 1 and 2. The positive terminal of the full-wave rectifier G1 is connected via a lead 3 to a terminal of the energizing coil AE, while the other terminal of the energizing coil is connected with the interconnected collectors of the transistors T2, T3. The emitter of the transistor T2 is connected via a lead 4 with the negative terminal of the full-wave rectifier G1. The collector-emitter path of the transistor T2 is bridged by the compensating resistor RV. The energizing coil AE thus lies in series with the transistor T2 and the compensating resistor RV, which is connected in parallel with the transistor T2. The base of the transistor T3 is connected via a resistor R4 with the positive lead 3. The common collector of the Darlington pair T1 is also connected with the base of the transistor T3 and the emitter of the Darlington pair T1 is connected with the negative lead 4. The base of the Darlington pair T1 is connected via a resistor R3 with the connection point between the resistor R2 and the capacitor C2.

The mode of operation of the electronic control described for the magnetic valve according to the preferred embodiment of the invention is as follows:

In order to actuate the magnetic valve, an operational voltage is applied to the leads 1, 2, which may be either an alternating voltage or a direct voltage with arbitrary polarity. This voltage proceeds via the full-wave rectifier G1 and the leads 3, 4 to the series circuit made up of the energizing coil AE and the transistor T2 with the compensating resistor RV connected in parallel therewith. When the base of the transistor T3 receives a positive voltage via the resistor R4, the transistor T3 becomes conductive and drives the transistor T2 into its conductive state as well. Thus, there is a voltage drop in the collector-emitter path of the transistor T2 of only a few tenths, so that the energizing coil AE is exposed to practically the full operational voltage. Simultaneously, charging of the capacitor C2 begins, via the resistor R2, to a voltage level which is determined by the Zener diode D1. This voltage is equalized by the capacitor C1, which is connected in parallel with this Zener diode D1. The voltage of the capacitor C2 proceeds via the resistor R3 to the base of the Darlington pair T1. As soon as this voltage attains a predetermined level, that is, the base-emitter voltage of the Darlington pair T1, the Darlington pair T1 becomes conductive. As a result, the positive voltage at the base of the transistor T3 is lowered. With a further increase in the voltage of the capacitor C2, the Darlington pair T1 is connected through, and the voltage at the base of the transistor T3 drops to such an extent that the transistor T3 is blocked. As a result, the transistor T2 is also blocked. As a result of this, the compensating resistor RV becomes fully effective in limiting the current flowing in the energizing coil AE.

In order to influence the switching behavior of the Darlington pair T1, a capacitor C3 is provided, which bridges the collector-base path of the Darlington pair T1. A series circuit is also provided parallel to the energizing coil and comprises a free-running diode D2 and a Zener diode D3, with the diodes having opposite polarities. These diodes serve to reduce the shutoff voltage peaks. The diode D2 blocks the flow of current during the shutoff procedure at a blockage voltage of approximately 0.8 volts, which produces a slowing down of the shutoff procedure of the magnetic system. This relatively low blockage voltage of 0.8 volts is raised by the Zener diode D3 to a level of 30 volts, for example, which reduces the voltage drop delay of the magnetic system. The Zener diode D3 can also be omitted; however, it is particularly suitable for operation at relatively high supply voltage levels.

For protecting the magnetic valve from excessive temperatures, two thermal-lag switches Th1 and Th2 are also introduced into the lead 2 which interrupt the electrical circuit upon attainment of a predefined temperature.

As a result of the use of a current amplification element in the form of a Darlington pair, the control current to be applied by the timing circuit is reduced to a very low level. Therefore, the resistor R2 can be selected to be relatively large and the capacitor C2, in contrast, relatively small. This enables a space-saving structure which in turn enables the installation of the electronic control circuit in a cavity in the magnetic valve. Because of the voltage limitation by the Zener diode D1 to 0.8 volts, for example, the capacitor C2 can be furthermore designed for low-level voltages and thus further reduced in size. Because of the voltage limitation, a relatively cost-favorable embodiment can also be chosen for the Darlington pair T1, because a low blockage voltage suffices.

By measuring the relationship between the resistance of the energizing coil and the value of the compensating resistor RV, the relationship of the attracting current to the maintenance current or of the attractive output to the maintenance output can be determined.

Figure 2:
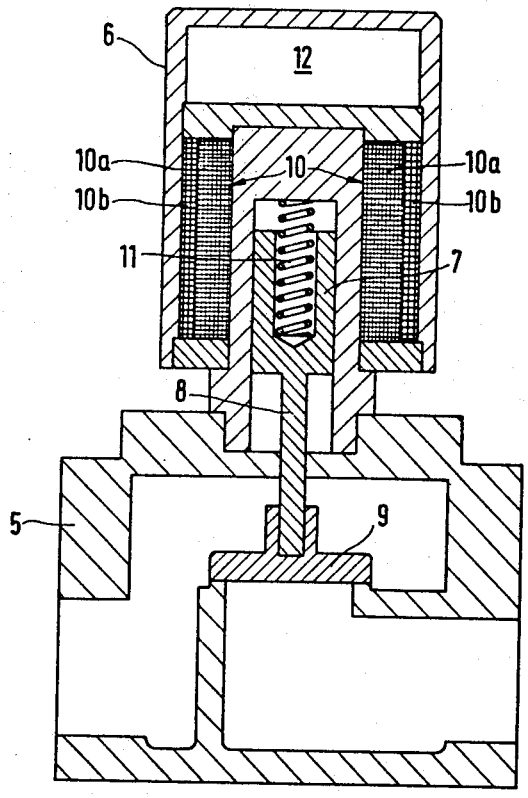
FIG. 2 is a cross-section view of a magnetic valve according to the invention, which in this example is a flat seat valve.

The magnetic valve shown in FIG. 2 includes a valve body 5 and an electromagnet 6 for actuating the valve via a plunger-type armature 7, which is connected via a rod 8 with the valve plate 9 of the magnetic valve. The electromagnet 6 contains a cylindrical energizing coil 10 into which the armature 7 is displaced. The armature is pressed into its position of rest by a restoring spring 11.

The winding of the energizing coil comprises two portions, a first portion 10*a* and a second portion 10*b*. The first portion is the actual winding, made up, for example, of cooper wire with varnish insulation. The second portion 10*b* is embodied by the compensating resistor RV, which is realized for this purpose as a resistance wire. The compensating resistor RV thus contributes to the number of ampere turns. Thus, with a given volume of the electromagnet, the maintenance current can be reduced. This is particularly advantageous when the magnetic valve is driven with direct current. In order to release the armature, a residual force must be overcome, and this is achieved by the restoring spring 11. The restoring spring must be selected to be stiffer in direct-current systems than in alternating-current systems, so that an increased maintenance output is necessary. For this reason, it is particularly effective in direct-current magnetic valves to wind up the compensating resistor, as a resistance wire, onto the energizing coil.

The electronic control means of the direct-current valve according to the invention may be structured in a particularly space-saving manner. It may be housed, for example, in a cavity 12 of the magnetic valve and filled in with a sealing compound such as epoxy resin.

The embodiment according to the invention of the overenergizing of the magnetic coil may be applied advantageously not only to seat valves of the type shown in FIG. 2, but also to other kinds of valves and in particular to hinged armature valves.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. An electronic control circuit for a magnetic valve having an energizing coil with two terminals for supplying an energizing current to said electronic control circuit comprising:

two input terminals for connection with said electric power source;

a full wave rectifier having two ac terminals and two dc terminals, said ac terminals being connected to said input terminals;

a current limiting resistor mounted between one of said dc terminals and one of said coil terminals, the other of said coil terminals being connected with the other of said dc terminals;

a transistor switch, mounted in parallel with said current limiting resistor and having a control terminal;

a biassing circuit for biassing said transistor switch into its conductive state during an initial energization period of said valve by providing a biassing current to said control terminal; and a timing circuit comprising a capacitor and a resistor for defining the duration of said initial energization period, said timing circuit being adapted to deactivate said biassing circuit at the end of said initial energization period.

2. The electronic control circuit of claim 1, wherein a current amplification transistor is provided the base electrode of which is connected to the junction of said capacitor and said resistor, the collector electrode of which is connected with the control terminal of said transistor switch and the emitter electrode of which is connected with one of said dc terminals.

3. The electronic control circuit of claim 2, wherein said current amplification transistor comprises a Darlington transistor pair.

4. The electronic control circuit of claim 1, wherein said transistor switch comprises a Darlington transistor pair.

5. The electronic control circuit of claim 2, wherein said biassing circuit comprises a resistor connected between said control terminal of said transistor switch and one of said dc terminals.

* * * * *